US007030736B2

(12) United States Patent
Bouchard et al.

(10) Patent No.: US 7,030,736 B2
(45) Date of Patent: Apr. 18, 2006

(54) RADIO FREQUENCY IDENTIFICATION (RFID) PIN DETECTION SYSTEM

(75) Inventors: Roland C. Bouchard, Grand Rapids, MI (US); Brent K. Bouws, Holland, MI (US); Kurt A. Dykema, Holland, MI (US); Warren E. Guthrie, West Olive, MI (US)

(73) Assignee: Brunswick Bowling & Billiards Corporation, Lake Forest, IL (US)

( * ) Notice: Subject to any disclaimer, the term of this patent is extended or adjusted under 35 U.S.C. 154(b) by 0 days.

(21) Appl. No.: 10/860,729

(22) Filed: Jun. 3, 2004

(65) Prior Publication Data

US 2005/0272511 A1 Dec. 8, 2005

(51) Int. Cl.
*G08B 23/00* (2006.01)

(52) U.S. Cl. ..... 340/323 B; 340/323 R; 340/572.1; 340/572.7

(58) Field of Classification Search .. 340/572.1–572.8, 340/442–447, 323 R, 323 B; 473/54, 101, 473/73

See application file for complete search history.

(56) References Cited

U.S. PATENT DOCUMENTS 3,781,009 A * 12/1973 Gagnon ..... 473/56
4,140,314 A 2/1979 Kaenel
4,205,843 A 6/1980 Murrey, Sr.
4,629,189 A 12/1986 Meniconi
4,827,412 A 5/1989 Form
5,241,379 A * 8/1993 Tsujita ..... 348/157
5,255,185 A 10/1993 Mowers et al.
5,461,385 A * 10/1995 Armstrong ..... 342/42
5,587,578 A * 12/1996 Serra ..... 235/492
5,602,556 A * 2/1997 Bowers ..... 343/742
5,618,238 A 4/1997 Kruse et al.
5,624,323 A 4/1997 Delaney et al.
5,628,693 A 5/1997 Mowers et al.
5,660,596 A 8/1997 Rochefort
5,683,080 A 11/1997 Vaioli et al.
5,709,607 A 1/1998 Mowers et al.
5,719,548 A 2/1998 Stirling et al.
RE35,778 E 4/1998 Stirling et al.
5,820,474 A 10/1998 Delaney et al.
5,830,074 A 11/1998 Rochefort
6,040,773 A 3/2000 Vega et al.
6,319,142 B1 * 11/2001 Ciniello ..... 473/54
6,433,671 B1 * 8/2002 Nysen ..... 340/10.41
6,441,724 B1 8/2002 Stirling et al.
6,450,892 B1 9/2002 Burkholder et al.
6,493,598 B1 12/2002 Shea
6,577,238 B1 6/2003 Whitesmith et al.
6,580,954 B1 * 6/2003 Shea ..... 700/91
6,607,123 B1 * 8/2003 Jollifee et al. ..... 235/375

(Continued)

OTHER PUBLICATIONS

MAG3it Pinsetting Supremacy Qubica Worldwide Program X Power to Perform.
Microchip AN680, "Passive RFID Basics"; 1998 Microchip Technology Inc., 7 pages.

(Continued)

*Primary Examiner*—Benjamin C. Lee
*Assistant Examiner*—Son Tang
(74) *Attorney, Agent, or Firm*—Brinks Hofer Gilson & Lione

(57) ABSTRACT

An RFID pin detection system includes bowling pins incorporating RFID tags and a pin deck incorporating reader antennas located in positions corresponding to the placement of the bowling pins. A controller energizes the reader antennas to activate RFID tags in those bowling pins that are in the pin-up position. The pin-up information is used in automatic scoring.

44 Claims, 9 Drawing Sheets

U.S. PATENT DOCUMENTS

| | | | | |
|---|---|---|---|---|
| 6,609,710 | B1 | 8/2003 | Order | |
| 6,611,556 | B1 | 8/2003 | Koerner et al. | |
| 6,621,410 | B1 | 9/2003 | Lastinger et al. | |
| 6,623,369 | B1 * | 9/2003 | Shea | 473/57 |
| 6,753,783 | B1 * | 6/2004 | Friedman et al. | 340/573.7 |
| 2001/0021672 | A1 | 9/2001 | Tsujita | |
| 2004/0103033 | A1 * | 5/2004 | Reade et al. | 705/16 |

OTHER PUBLICATIONS

Texas Instruments, "TI-RFID Product Manuals"; 11-03-21-002; Nov. 2001, 14 pages.

Beigel Technology Corporation, "Dynamic Performance of Inductive RFID Systems"; http://www.beitec.com/articles/dynamic/dynamic1.html; Aug. 30, 1999, 3 pages.

Beigel Technology Corporation, "Signal Transmission Protocol"; http://www.bitec.com/articles/dynamic/dynamic 2.html; Aug. 30, 1999, 3 pages.

Beigel Technology Corporation, "Dynamic Tag-Reader Interaction"; http://www.beitec.com/articles/dynamic/dynamic3.html, Aug. 30, 1999, 2 pages.

Beigel Technology Corporation, "Addendum for Fisheries Applications"; Presented at the PIT Tag Workshop 2000, Jan. 12, 2000, http://www.beitec.com/articles/dynamic/dynamic4.html, 3 pages.

Howstuffworks "How E-ZPass Works"; http://auto.howstuffworks.com/e-zpass.htm/printable, Sep. 29, 2003, 4 pages.

VPS Video Pin Sensor, "Advanced Video Pin Sensor technology improves accuracy under any light condition"; 2002 Brunswick Bowling & Billiards Corporation, 1 page.

QUBICA Pin Detection System, Software Controlled Devices, 2 pages, (2003).

* cited by examiner

RADIO FREQUENCY IDENTIFICATION (RFID) PIN DETECTION SYSTEM

BACKGROUND OF THE INVENTION

1. Technical Field

This invention relates generally to bowling systems, and, more particularly, to a radio frequency identification (RFID) pin detection system.

2. Description of the Related Art

Bowling centers have evolved from systems that required the manual setting of ten pins on a lane and manual scoring during game play, to systems that utilize automatic pinsetting devices, and ultimately to systems that utilize automatic bowling scoring systems.

Automatic scoring systems for bowling centers have been provided that respond to an output produced by a pin fall monitor in order to automatically score each bowler's game. The automatic scoring system typically includes a scoring console having a display device and a user input for displaying information, including scores, and for entering the names of the bowlers, correcting scoring errors, and the like. One such system is disclosed in commonly owned U.S. Pat. No. 5,255,185 entitled BOWLING CENTER VIDEO DISPLAY SYSTEM, the disclosure of which is hereby incorporated herein by reference.

The above-mentioned pin fall monitor is provided to automatically detect the number of fallen pins after a ball has been thrown by a bowler. In this regard it is known to provide pin fall monitors that rely either on mechanical contacts, switches or video processing technology. For example, it is known to provide mechanical "paddle" switches in a setting table of a pinsetter. The setting table is lowered to count pins after a ball has been thrown. The paddle switches are configured to engage the heads of standing pins. The number of standing pins is determined based on "paddle" switch closures. As with other mechanical or electromechanical devices, such "paddle" switches are subject to wear and break down, requiring maintenance. Wear and/or break down may be advanced due to the high impact environment in which they are used. In addition, the requirement of lowering the setting table to take the standing pin count can, in some circumstances, introduce a delay. More specifically, in the case where there are one or more pins standing after a ball has been thrown, the setting table must be lowered to respot the pins in any event, so there is no additional delay in these situations. However, in the case where the bowler rolls a strike, and thus no pins are left standing, the setting table must go through at least one down cycle in order to determine that there are no pins standing (i.e., a strike) and then to clear the pin deck and respot a new complement of pins. The double down stroke for a strike is perceived by some bowlers as being slow.

As to video processing technologies for pin fall detection, it is known to employ a charge couple device (CCD) for capturing an image of the pin deck area. The captured image is then processed to determine the number of pins standing after a ball has been thrown by a bowler. Such bowling scoring systems are conventionally organized around a pair of bowling lanes. In this regard, CCD-based video systems typically use one camera to image both bowling lanes. While such systems provide accurate results under normal lighting conditions, performance in low lighting conditions prevalent in popular ultraviolet light ("black light" or glow-in-the-dark) bowling environments tend to be problematic. Such systems also tend to require frequent alignment and calibration.

It is also known to provide a pin fall monitor that uses video pin sensor technology that improves accuracy under both black light and white light conditions. However, video pin sensor technology incorporates two cameras per lane pair and while providing improved levels of convenience, accuracy, and bowler satisfaction under black light bowling conditions, as well as independent visual assessment of pins per lane, such video-based systems may be characterized by an increased cost.

In addition, it is known to provide a bowling pin with a magnet in the head portion thereof as seen by reference to U.S. Pat. No. 5,660,596 entitled MAGNETICALLY RESPONSIVE BOWLING PINS. It is also known to use such magnetically-responsive pins for scoring.

There is therefore a need for a bowling pin detection system that minimizes or eliminates one or more of the problems set forth above.

SUMMARY OF THE INVENTION

The present invention provides a pin detection system that provides accurate pin detection under all lighting conditions, reduces maintenance, reduces overall system cost, as well as improves scoring/pinsetting speed under some circumstances (i.e., can eliminate pinsetter double stroke). Other features, advantages, and objects are achieved by a bowling pin detection system according to the invention that employs radio-frequency identification (RFID) tags.

In one aspect of the invention, a bowling pin detection system is provided for use with bowling pins of the type wherein each pin includes a respective RFID tag including a pin antenna configured to identify the pin. The bowling pins are conventionally placed on a pin deck in a predetermined arrangement. The system comprises a pin detect controller, a monitor block, and a plurality of reader antennas. The pin detect controller is responsive to a pin fall signal to generate a reader activation signal. In one embodiment, the pin fall signal is produced by a conventional pinsetter apparatus and is indicative of a time to determine the number of fallen pins. The monitor block includes an antenna drive circuit responsive to the activation signal configured to energize the reader antennas. The reader antennas are configured, when energized by the antenna drive circuit, to radiate a respective reader field to a corresponding position in the predetermined arrangement. In one embodiment, the reader antennas are disposed in the pin deck. In another embodiment the reader antennas are disposed proximate the setting table of the pinsetter. The reader antennas are further configured to sense modulations in the reader field when a bowling pin in the pin-up position (i.e., standing) is within a range of one of the positions in the predetermined arrangement (i.e., is within one of the reader fields, which activates the RFID tag causing the modulations to occur). In one embodiment, the predetermined arrangement of bowling pins is the well-known triangular ten-pin arrangement.

The monitor block includes a filter and amplifier circuit configured to process the sensed modulations from the reader antennas for detecting bowling pins in the pin-up position and generating an output signal. The pin detect controller is responsive to the output signal of the monitor block to generate a pin detection signal indicative of, in alternate embodiments, the number of standing and/or fallen bowling pins.

In another aspect of the present invention, a bowling pin is provided that is configured for use in an RFID pin detection system. The bowling pin includes a body having a base, a neck and a head portion. The bowling pin includes an RFID tag having a pin antenna. The pin antenna is responsive to the reader field and is configured to generate a power signal. The RFID tag is responsive to the power signal for activation thereof wherein the RFID tag is configured to produce an identification signal for identifying the pin. The identification signal may be sensed and used for, among other things, scoring a bowling game.

In a still further aspect of the present invention, a pin deck is provided. The pin deck is configured for use at a first end of a bowling lane opposite a second, approach end. The pin deck comprises a base layer, an upper layer, and at least one reader antenna intermediate the base layer and the upper layer. The upper layer has a top surface configured for placement of a plurality of bowling pins in a predetermined arrangement. The reader antenna is configured to radiate a reader field to a corresponding position in the predetermined arrangement. The reader antenna is further configured to sense modulations in the reader field when a bowling pin, of the type that includes an RFID tag having a pin antenna, is within a predetermined range of the radiated position.

In a still further aspect of the present invention, an automatic bowling pinsetter is provided. The pinsetter includes a pin elevator configured to receive bowling pins, for example from a pit conveyor or the like, and to elevate the pins to an orienting and delivery mechanism. The orienting and delivery mechanism is configured to orient the bowling pins in a desired fashion for delivery to a plurality of pin stations. The pinsetter further includes a setting table configured to receive the bowling pins from the pin stations for setting on the pin deck in a predetermined arrangement. The setting table includes a plurality of apertures corresponding to the predetermined pin arrangement for receiving bowling pins, the table being configured to selectively engage, hold and release bowling pins. The setting table is movable between upper and lower positions for both (i) setting bowling pins in the predetermined arrangement on the pin deck, and (ii) for picking up and resetting bowling pins on the pin deck. According to the invention, the pinsetter also includes a plurality of reader antennas disposed proximate the apertures in the setting table. The reader antennas are configured to radiate a respective reader field to a corresponding position in the predetermined arrangement. The reader antennas are further configured to sense modulations in respective reader fields that occur when a bowling pin of the type that includes an RFID tag is within a predetermined range of the position.

In a yet further aspect of the present invention, a method of tracking a bowling pin is provided. The first step of the method involves providing a bowling pin having a pin antenna associated therewith configured to generate a power signal in response to a reader field. The pin also includes an RFID tag responsive to the power signal for activation thereof. The RFID tag is configured to store an identification code for identifying the pin. The method further includes the step of deploying the bowling pin on a first, deployment date. The method further includes the step of associating the identification code with the deployment date in a computer database. The method further includes, on a second date subsequent to the deployment date, the step of applying a reader field to the bowling pin to thereby activate the RFID tag to obtain the identification code. Finally, the method includes the step of retrieving the deployment date using the identification code. In one embodiment, the method further includes the step of determining warranty coverage using the retrieved deployment date and warranty data associated with the pin.

In a still further aspect of the invention, a method of bowling is provided. The method includes the step of spotting a plurality of bowling pins on a pin deck in a predetermined arrangement wherein each bowling pin includes a respective RFID tag configured to produce an identification signal in response to a reader field. The method further includes the step of, in response to a pin fall signal indicative of a thrown ball, determining the number of pins in a pin-up position using the RFID tags. Finally, the method includes the further step of providing the determined number of pins in the pin-up position to a bowling scoring unit.

Further features and advantages of the invention will be readily apparent from the specification and from the drawings.

BRIEF DESCRIPTION OF THE DRAWINGS

The present invention will now be described by way of example, with reference to the accompanying drawings.

DETAILED DESCRIPTION OF THE PREFERRED EMBODIMENTS

The game of bowling is played on a bowling lane that typically includes an automatic pinsetter operable for setting ten pins on the lane at the start of a game. In a conventional ten pin bowling game, each bowler is allowed to roll two balls in an attempt to knock down all of the pins. The throwing of two balls constitutes what is known as a frame, except that three balls may be permitted in the tenth frame, and the completion of ten frames comprises one game. The player's score is determined according to the number of pins that are knocked down in each frame. In a bowling center that includes an automatic scoring system, the score is automatically computed and displayed on a suitable display screen or printed out using a printing device.

A basic input required for an automatic scoring system is the number of bowling pins knocked down after the player has thrown a bowling ball down the lane. The conventional pin sensing systems rely either on mechanical (or electro-mechanical) switches or on video processing technology. The mechanical systems tend to require a fair amount of maintenance, and the video approach tends to be problematic in low lighting conditions prevalent in the popular "glow-in-the-dark" bowling environments. The present invention provides a pin detection system that uses radio-frequency identification (RFID) tag technology to overcome one or more of the shortcomings of conventional pin sensing systems. As will be seen, the invention provides accurate scoring under all lighting conditions, reduces cost and provides improved speed of operation.

Figure 1:
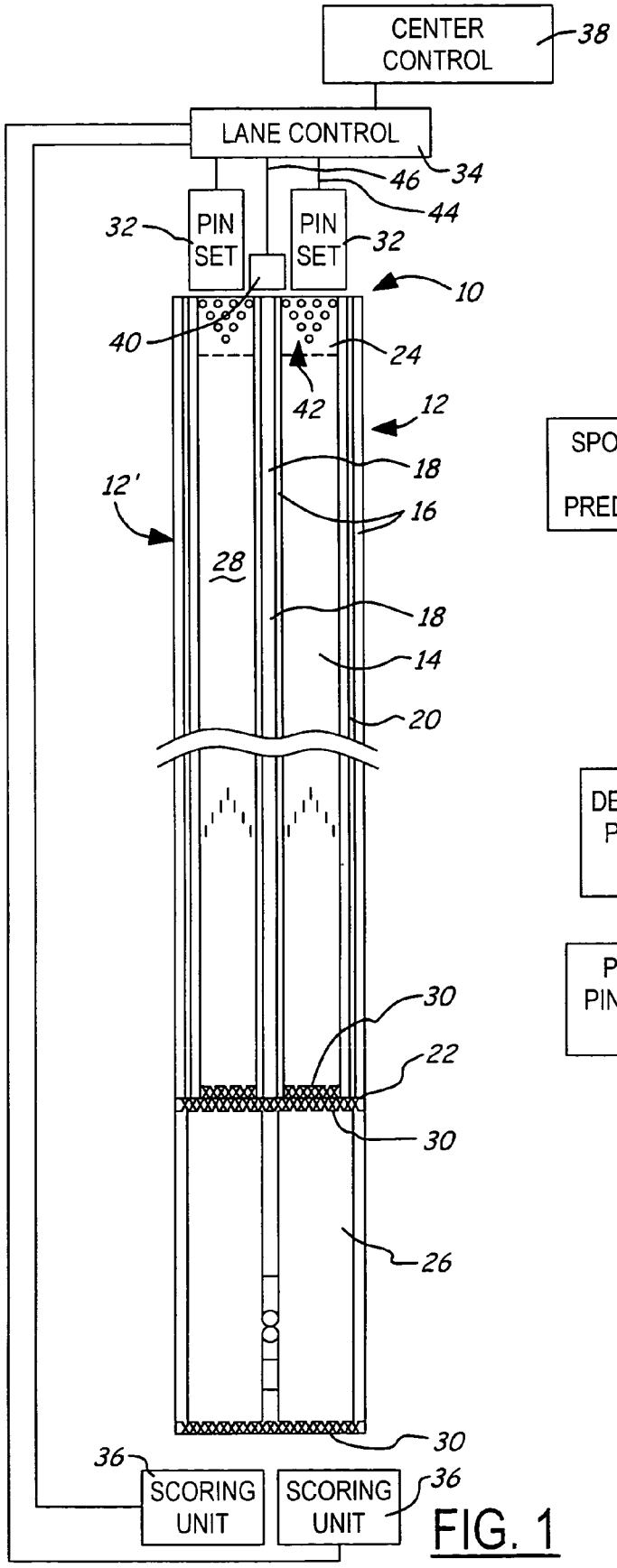
FIG. 1 is a diagrammatic and block diagram view representing an overview of a bowling center having an RFID pin detection system according to the invention.

Referring now to the drawings wherein like reference numerals refer to identical components in various views, FIG. 1 shows a two lane ("lane pair") arrangement 10 including first and second lane assemblies 12 and 12' in a typical arrangement with each lane assembly having a lane 14 being straddled by a pair of gutters 16. It should be understood that a bowling center includes, typically, many more bowling lanes than are shown, although it is still typical to group lanes in pairs. Between the two lane assemblies is a ball return capping 18, which is above a ball return channel of conventional construction. At the opposite sides of the two lanes from the ball return capping are lane divisions 20, also of conventional constructions.

Each lane 14 may be of standard length, i.e., 60 feet plus or minus one-half inch as measured from a foul line 22 to the center of the number one pin on a pin deck 24. At the head of the lane, i.e., adjacent foul line 22, is what is known as an approach 26. The approach 26 is where the bowler advances toward the lane with the ball in hand in order to bowl the ball down the lane towards the pins on the pin deck 24. The lane may be of standard width of 41½ inches plus or minus one-half inch, according to the standards of the American Bowling Congress (ABC).

The bowling lanes shown in FIG. 1 may be formed of wood, synthetic material and/or may be of the type having a polymer sheet 28 extending from foul line 22 to the rear edge of pin deck 24, adhered thereto by double sided tape or the like 30, all as known in the art.

Associated with each lane is an automatic pinsetter 32. The two pinsetters 32 of each lane pair are electrically connected to a lane control system 34. The lane control system 34 operates both pinsetters 32 to set a desired array of pins according to the bowling game being played, and to provide automatic scoring for the bowling game being played. Also connected to each lane control 34 is a scoring unit input terminal 36, which is used by a bowler to enter information to be transmitted to the lane control system 34. The scoring unit input terminal 36 is physically located, typically, near a bowling staging area immediately adjacent to the associated approach area 26. A respective overhead display monitor (not shown) is generally provided for the left and right lanes of each lane pair to display scoring and other types of information. While some embodiments of lane control system 34 operate with respect to a lane pair (i.e., the two lanes adjacent one another), other embodiments of lane control system 34 are configured to control up to as many as eight lanes.

A bowling center control 38 is configured to communicate with each lane control system 34 over a communications line. The bowling center control 38 may be located in a typical bowling center at a manager's control desk (MCD) and provides accounting control of the bowling lanes as well as the ability to download game information to lane control system 34. Lane control system 34 and bowling center control 38 may comprise conventional apparatus known to those of ordinary skill in the art.

FIG. 1 further shows, in accordance with the present invention, an RFID pin detection system 40. RFID pin detection system 40 is configured to detect the status of a pin as being in either the pin-up position or in the pin-down position and to communicate this information to a bowling scoring unit (e.g., scoring software executing on lane control 34). FIG. 1 further shows a plurality of bowling pins set-up in a predetermined arrangement 42, which, as graphically illustrated, comprise ten pins in the typical triangular configuration with the number one pin being at the front apex of the triangle and the number seven and ten pins being at the rear corners of the triangle. It should be understood that other predetermined arrangements for the bowling pins are contemplated within the spirit and scope of the present invention.

RFID pin detection system 40, in response to a pin fall signal 44 indicative of the time to take the pin count (typically generated by pinsetter 32), is configured to determine the number of pins in the pin-up position using the RFID tags in the bowling pins. System 40 is further configured to generate a pin detection signal 46 and provide the same to lane control 34. The pin detection signal 46 is indicative of at least one of (i) the number of pins in the pin-up position or (ii) the number of fallen pins or pins in the pin down position. In further embodiments, other identifying information (e.g., the position of the standing pin in the overall pin arrangement) may be included in the pin detection signal 46 provided to lane control system 34, among other pieces of information. FIG. 1 shows RFID pin detection system 40 in block form, which will be described and illustrated in greater detail hereinafter.

Figure 2:
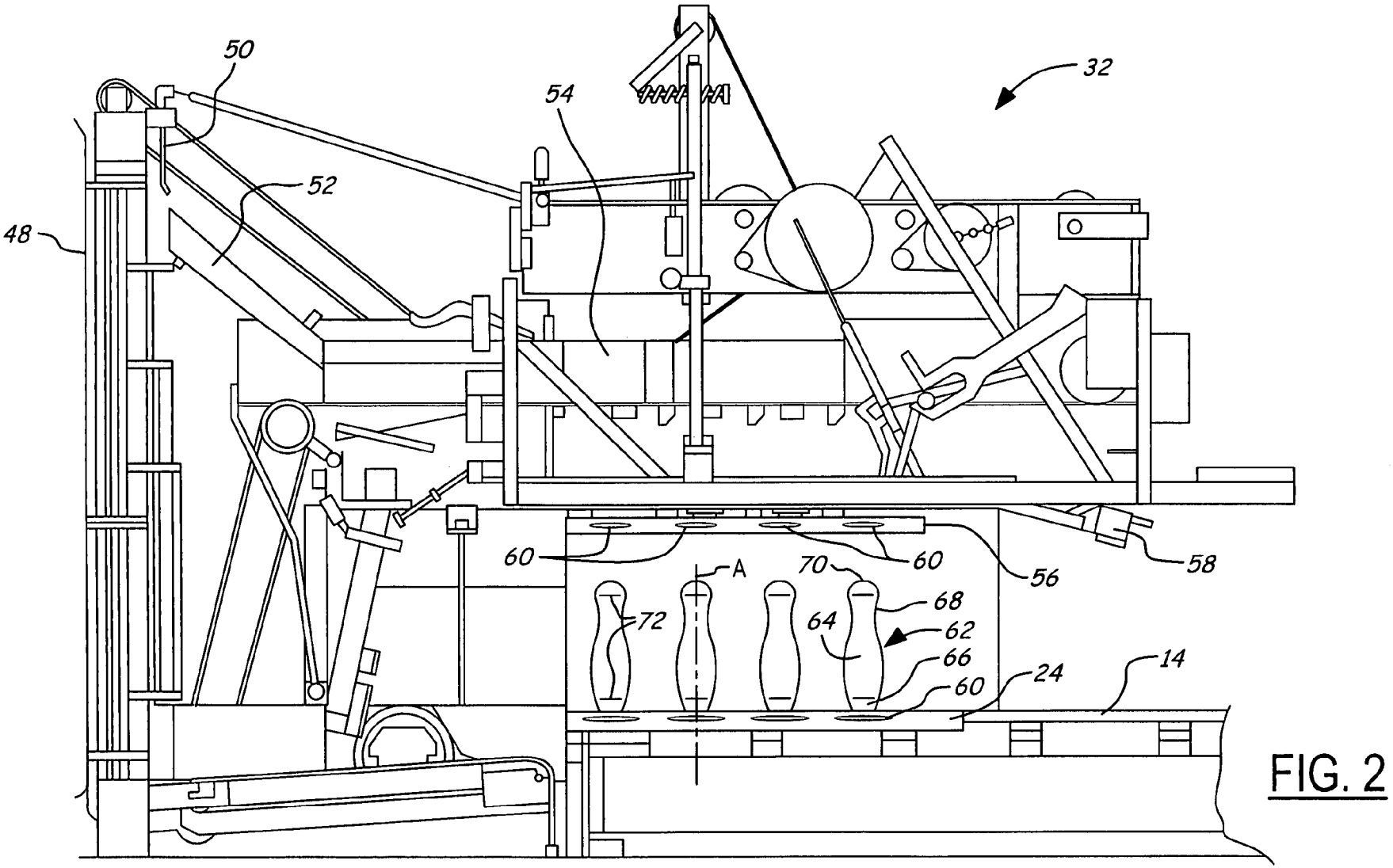
FIG. 2 is an elevational view, with parts removed for clarity, of an automatic pinsetting apparatus according to the present invention.

FIG. 2 shows an automatic bowling pinsetter 32 suitable for use with the present invention. The pinsetter 32 is operable to set up a predetermined number of pins (e.g., ten pins) in predetermined arrangement 42, which may be a conventional bowling triangular configuration or array. Selected portions of a conventional pinsetter are illustrated in FIG. 2 in order to describe the operation thereof which may enhance the understanding of the operation of the inventive RFID pin detection system 40.

Pinsetter 32 includes a pin elevator 48, which receives pins randomly from a conventional pit conveyor (not shown) and elevates them to a pin turn 50. Pin turn 50 orients the pins base first and deposits them into a pin chute 52 which, in turn, delivers the oriented pins into a distributor 54. The distributor 54 delivers the pins to a plurality of pin stations, ten in the illustrated embodiment, for eventual unloading to a setting table 56. The setting table 56 includes a plurality (e.g., ten) tipping baskets, one for each pin, for holding pins which are to be set on the lane. Each tipping basket may include a solenoid configured to operate a pair of flaps to controllably engage the neck of a pin prior to setting it on the pin deck. A scissors is used to lift a standing pin when the deck is to be swept and to release a pin for respotting.

The setting table 56 is moveably mounted so that it may be lowered to pick up and then respot standing pins after a rake 58 has removed fallen pins, or to set a new group of pins on the pin deck. A more detailed description of a suitable pinsetter may be had by reference to U.S. Pat. No. 5,709,607 entitled AUTOMATIC BOWLING CENTER SYSTEM, herein incorporated by reference.

In one embodiment of the present invention, RFID pin detection system 40 employs a passive RFID system. Passive RFID systems include, generally speaking, a reader (i.e., sometimes also known as an interrogator), a passive RFID tag, and a control. In one embodiment, the reader may be located near the setting table 56 of pinsetter 32, designated in FIG. 2 as reader antennas 60. In an alternative embodiment, reader antennas 60 may be located in pin deck 24, also as shown in FIG. 2.

FIG. 2 also shows exemplary bowling pins 62. Each bowling pin 62 has a main longitudinal axis designated "A" in the drawings. Pin 62 includes a main body portion 64 having a base portion 66, a neck portion 68, and a head portion 70. As described above, the three main components of a passive RFID system include a reader, an RFID tag, and a control. In one embodiment where the reader antennas 60 are disposed in the setting table 56, the bowling pins are arranged to include the RFID tag 74 (having a pin antenna 72 and a processor 73) in the head of the pin. In a second embodiment where the reader antennas 60 are located in the pin deck 24, the pin antenna 72 is preferably located in the base 66 of pin 62. As will be described in greater detail hereinafter, the relative distance and orientation of the bowling pin antenna relative to the reader antenna is important in accurately discriminating between a pin in the pin-up position and in the pin-down position.

Figure 3:
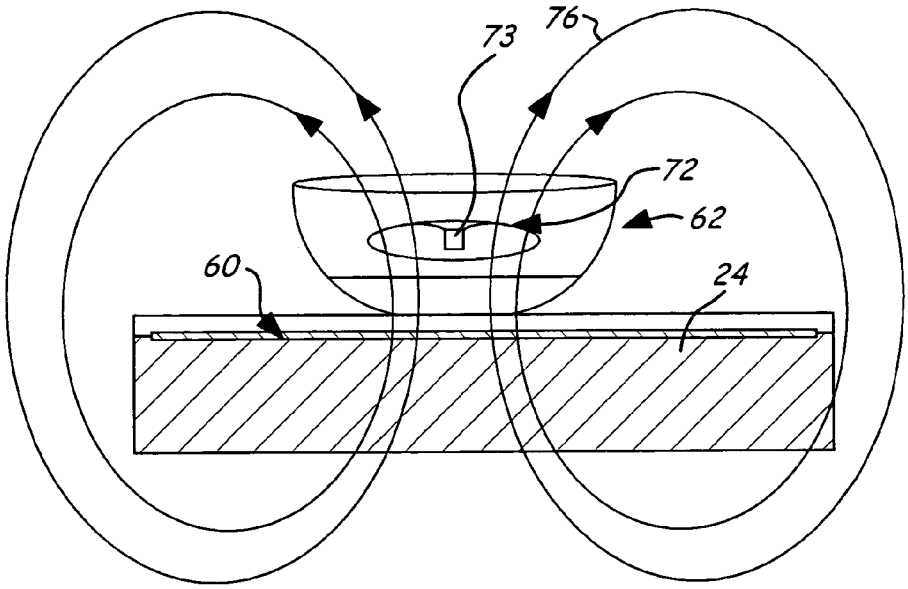
FIG. 3 is a partial cross-sectional view showing a bowling pin and pin deck configured according to the present invention.

FIG. 3 shows, in greater detail, the relationship between a bowling pin 62 having an RFID tag 74 and a pin deck 24 with a reader antenna. In the illustrated embodiment, pin antenna 72 is disposed in the base of pin 62. The reader antenna 60 is located under the surface of a pin deck 24. The reader antenna 60 is configured to radiate a reader field 76 (i.e., a radio frequency signal). The reader antenna 60 is configured to transmit energy to the pin antenna 72, and to read information back from the pin antenna 72. In the illustrated embodiment, the reader antenna 60 is a generally circular-shaped coil lying parallel to a top surface of pin deck 24. Pin antenna 72 is substantially parallel to reader antenna 60 when pin 62 is standing in a vertical (i.e., pin-up) position. Since in a passive RFID system of the present invention, no battery or other power source is available in pin 62, the reader antenna 60 must be configured so as to induce enough power into pin antenna 72 of RFID tag 74 so that a power signal can be produced for activation thereof. Once RFID tag 74 has been activated, it is configured to produce an identification signal for identifying pin 62. As will be described in greater detail below, the tag 74 is operative to modulate field 76, which can be detected by reader antenna 60 and processed to recover the identification signal that identifies pin 62. However, when the pin is not in the pin-up position, the orientation of the pin antenna relative to the reader antenna changes so as to reduce the inductive coupling therebetween. Discriminative coupling levels is how the system 40 distinguishes pin-up from pin-down.

Figure 4:
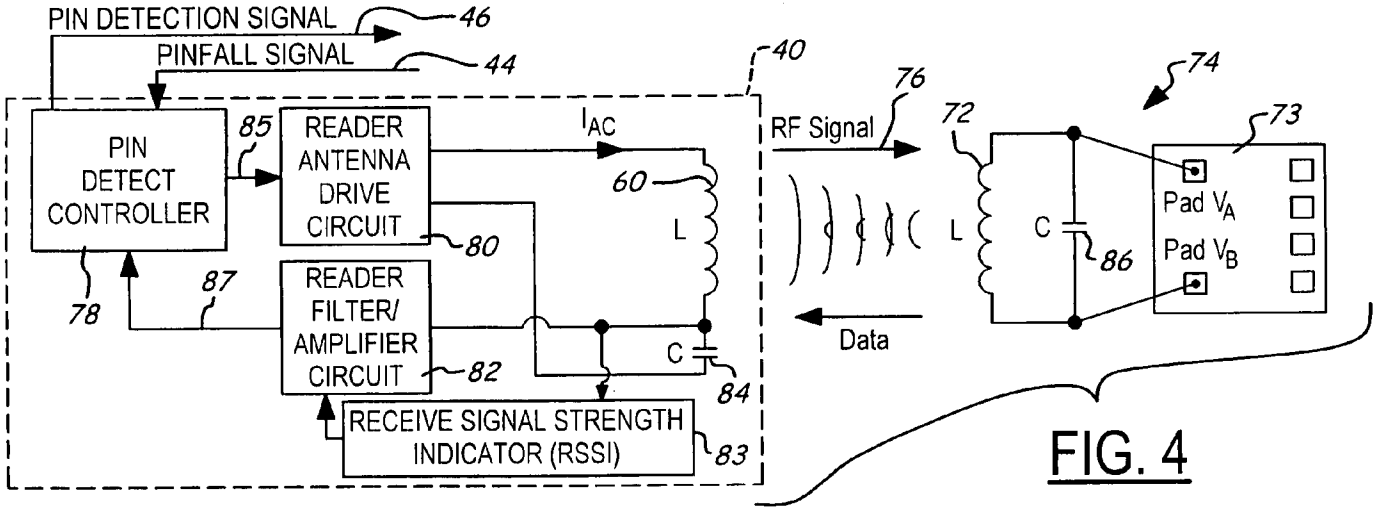
FIG. 4 is a schematic and block diagram view of an RFID pin detection system in accordance with the present invention.

FIG. 4 is a schematic diagram showing FIG. 3 in greater detail. RFID pin detection system 40 may include a pin detect controller 78, a reader antenna drive circuit 80, a reader filter/amplifier circuit 82, optionally a receive signal strength indicator (RSSI) block 83, and a tuning capacitor 84.

Pin detect controller 78 is responsive to the pin fall signal 44 for generating a reader antenna activation signal 85. Controller 78 may comprise conventional devices, such as a microprocessor having suitable input/output (I/O), non-volatile memory and random accessory memory. The controller 78 is configured to execute routines consistent with the teaching described elsewhere herein.

Reader antenna drive circuit 80 is responsive to the activation signal 85 and is configured to energize the reader antenna 60. An energizing current designated $I_{AC}$, is fed through the reader antenna 60, which is coupled in series with tuning capacitor 84, in order to form a resonant circuit. The energizing current $I_{AC}$ generally comprises a sine wave of a suitable frequency, for example, at ISO frequencies of 125 kHz and 13.56 MHz. In one embodiment, the frequency is 125 kHz. The resulting radio frequency signal is defined in part by the reader field 76, which is received by (coupled to) the pin antenna 72 portion of RFID tag 74, which is arranged in parallel with a tuning capacitor 86, also forming a resonant circuit. In effect, the arrangement of FIG. 4, in its simplest form, forms an air core transformer.

The RFID tag 74 may comprise conventional components known to those of ordinary skill in the art, and generally includes a processor in the form of a solid state device 73 in addition to the pin antenna 72 described above. The RFID tag 74 may include an on-board rectification bridge (not shown) for rectifying the received signal from antenna 72 in order to produce an internal power signal for activation of the processor 73 of RFID tag 74. The RFID tag 74 also includes a circuit such as a transistor for modulating the amplitude of the carrier signal (i.e., the field 76) to transmit data from the RFID tag 74 back to the reader antenna 60.

Reader filter/amplifier circuit 82 is configured to process the sensed modulations in the reader field 76 picked up by the reader antenna 60 (and tuning capacitor 84), and process the sensed modulations in generating an output signal 87. The pin detect controller 78 is responsive to the output signal 87 and is configured to generate the pin detection signal 46 that is indicative of the number of bowling pins in the pin-up position.

Figure 5A:
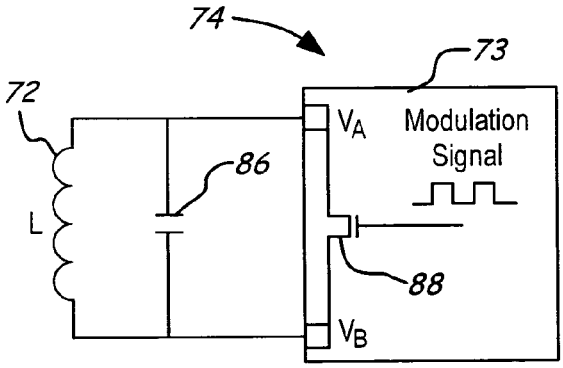
FIG. 5A is a schematic diagram showing, in greater detail, the RFID tag with pin antenna of FIG. 4 with a solid state modulation switch.
Figure 6:
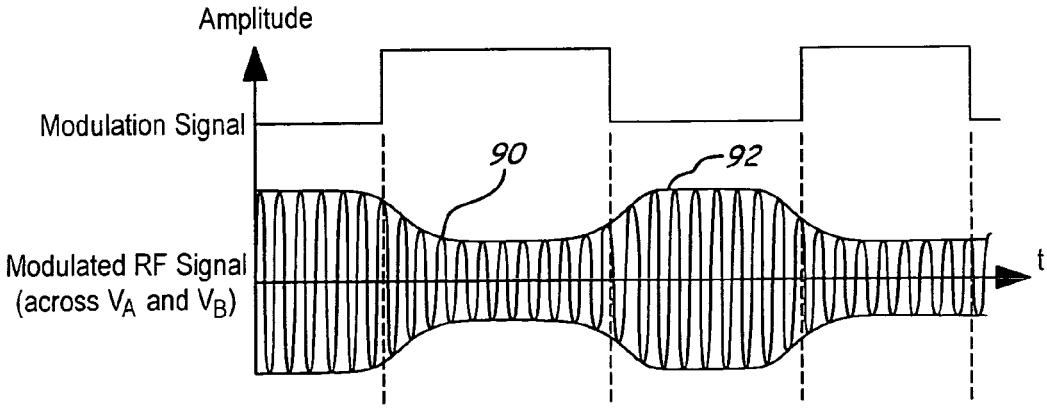
FIG. 6 is a timing diagram showing a modulated radio frequency signal between a reader antenna and the pin antenna.

FIGS. 5A and 6 show one approach for modulating the amplitude of the reader field 76 by RFID tag 74. The processor 73 portion of RFID tag 74 includes an internal memory in which is stored an identification code, which may comprise a multi-bit data code. Once the processor 73 has been activated, it begins clocking out its data (e.g., the identification code) to output switch 88, which is shown in FIG. 5A as a solid state transistor. Switch 88 is coupled across the terminals of pin antenna 72.

FIG. 6 is a timing diagram showing the field 76 as modulated by the data (e.g., the identification code) being clocked out to switch 88. Switch 88 selectively shunts the pin antenna 72 corresponding to the data that is being clocked out of the RFID tag's memory. When the antenna is shunted, the field is dampened, which results in a small decrease in the amplitude, as shown by portion 90 in FIG. 6. When the pin antenna 72 is not shunted, the field 76 (RF signal) resumes its previous amplitude. The reader filter/amplifier circuit 82 is configured to detect the small fluctuations shown in FIG. 6 to produce the output signal 87, which may be in digital format. It is known to provide a variety of modulation schemes within RFID tag 74. The particular modulation scheme, if any, implemented in RFID tag 74 is taken into consideration by pin detect controller 78 in demodulating the raw digital data contained in output signal 87. Through the modulation and demodulation processes, pin detect controller 78 can recover, for example, the identification code conveyed by a bowling pin via RFID tag 74. Using the preexisting knowledge of the bowling pin arrangement, pin detect controller 78 can be configured to determine, using the knowledge of the pins in the pin-up position, what pins are in the pin-down position and thus provide a pin detection signal 46 communicating either one or both of (1) pins standing or (2) fallen pins.

Figure 5B:
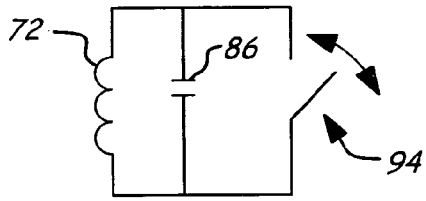
FIG. 5B is a schematic diagram showing, in greater detail, the RFID tag with pin antenna of FIG. 4 with a gravity-actuated modulation switch.

In an alternate embodiment, as shown in FIG. 5B, the modulating switch may take the form of a gravity-actuated switch 94 (e.g., mercury switch) having an open position and a closed position. The switch 94 is arranged in the pin 62 so as to assume one of the open or closed positions when the pin is in the pin-up position, and to assume the other one of the open/closed positions when the pin is in the pin-down position. The switch 94, as shown, is electrically coupled to the antenna 72 (but could alternately be coupled to the processor 73 portion of the RFID tag 74) so as to alter the operation of the antenna 72 (or processor 73) in dependence on whether the pin is in the pin-up or the pin-down position. This embodiment, in-effect, is a low cost approach in implementing a one-bit identification code.

Figure 7:
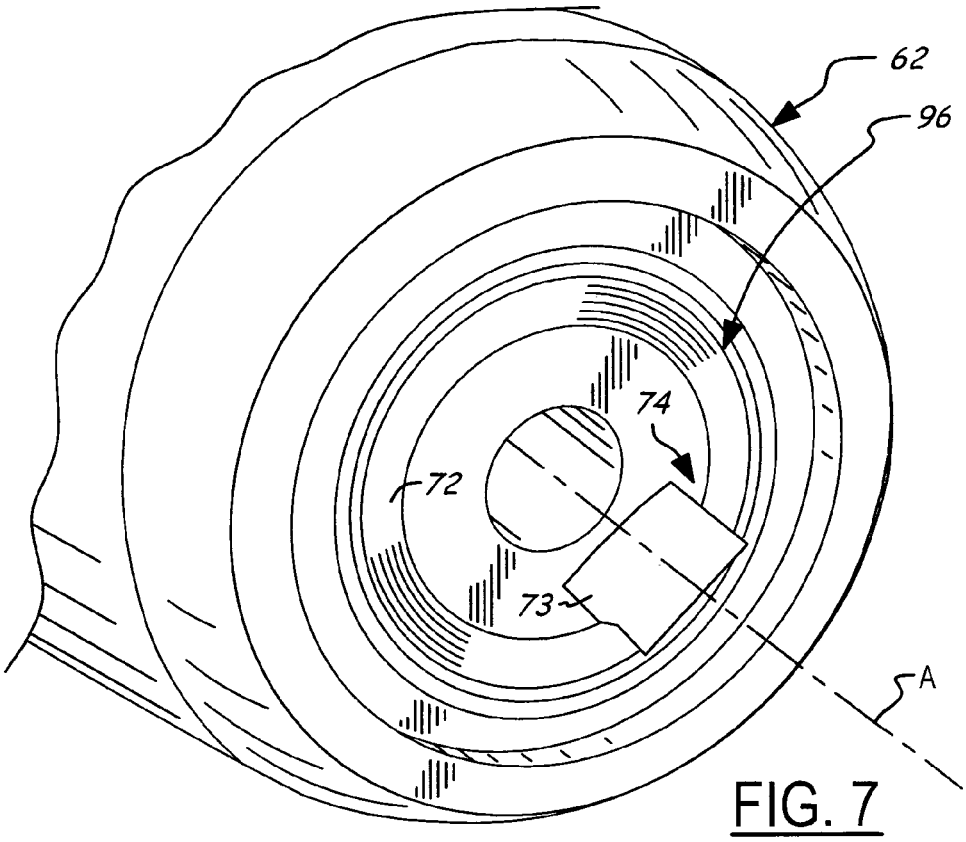
FIG. 7 is a perspective view of the base of a bowling pin showing an installed RFID tag with pin antenna.

FIG. 7 is a perspective view of a base of a bowling pin 62, showing the physical details of one embodiment. Bowling pin 62 includes a cavity 96 configured in size and shape to accommodate RFID tag 74 including the pin antenna 72 and the processor 73. The main axis of pin 62, axis "A", extends through the base, neck and head portions of the pin. The pin antenna 72, in the illustrated embodiment, encloses an area through which the main axis "A" passes. In a preferred embodiment, the pin antenna 72 comprises a plurality of loops of electrically conducting material (e.g., wire) and lies generally in a plane that is substantially perpendicular to the main axis "A." After installation, the RFID tag 74 (i.e., namely the processor 73 and pin antenna 72) are embedded by filling the cavity 96 with a suitable encapsulant. This approach provides a suitable level of durability for the intended environment.

As described above, when a pin is standing in the vertical, pin-up position, the reader antenna and the pin antenna are located close together, and are substantially parallel for a maximum, first level of inductive coupling. When the bowling pin is knocked down, however, the pin antenna rotates out of optimal position and away from the reader antenna, thereby reducing the amount of inductive coupling to a second, lower level. The present invention provides for discrimination of the pin-up position versus the pin-down position under a wide variety of conditions. A particularly challenging condition is the sliding pin that stays standing. This condition should not be counted as a pin-down, but may be difficult to distinguish from a pin that has been knocked completely off the pin deck, because of the reduced coupling when the pin is moved out of optimal position with respect to a particular reader antenna.

Figure 8:
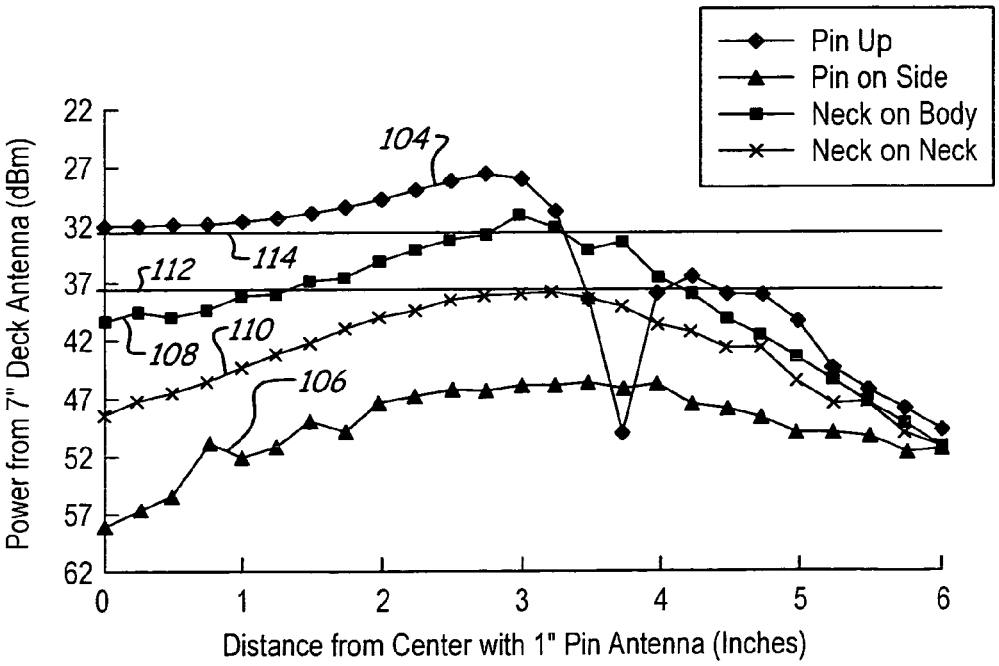
FIG. 8 is a chart showing various coupling levels between a reader antenna and a pin antenna.

FIG. 8 is a chart showing power coupling levels between the reader antenna 60 and the pin-antenna 72 for various situations including (1) a bowling pin in the pin-up position, shown as trace 104; a pin in the "pin-down" position including (2) a pin on side condition, shown as trace 106; (3) a pin where its neck is on the body of another pin, shown as trace 108; and (4) a pin where its neck is on the neck of another pin, shown as trace 110. Also note the chart takes into account the sliding pin condition in trace 104 in terms of an offset distance shown on the X-axis. The chart shown in FIG. 8 represents data taken from a reader antenna (e.g., disposed in pin deck 24) having a 7 inch diameter (i.e., 3.5 inch radius). One design parameter is the size of the reader antenna 60. Conventional spacing between bowling pins in a ten-pin triangular arrangement is 12 inches (center-to-center). FIG. 8 shows that while the bowling pin antenna 72 is within the radius of the reader antenna 60 (i.e., 3.5 inches), there is a relatively large power difference (greater than 15 dB) between trace 104 ("pin-up") and trace 106 ("pin on side"). This indicates that the risk is very low that a pin that has completely fallen over but still on the pin deck will be incorrectly identified as a pin that is in the pin-up position.

FIG. 8 also shows that there is approximately a 6 dB of power difference between trace 104 ("pin-up") and trace 110 ("neck on neck"). Of course, bowling pins knocked completely off pin deck 24 will have minimal if any measurable coupling.

As described above, one condition to be accounted for is the sliding pin condition. FIG. 8 shows a noticeable "null" at about 3.5 inches from center. This null corresponds to a point when the pin antenna 72 is directly above the windings of the reader antenna 60. At this point half of the reader field is split across the windings of the reader antenna and the net coupling is about zero.

Accordingly, in view of the foregoing observation, filter/amplifier circuit 82 is configured to include discrimination logic having a threshold selected to reject traces 106 and 110 as relating to pin-down pins and to receive and process trace 104 as relating to pin-up pins. Thus, pins that have been knocked completely off pin deck 24, or that remain on pin deck 24 but have been knocked on their side or are in a neck on neck position, will exhibit insufficient coupling to overcome the discrimination function described above, and will be considered as pins in the pin-down position. A default discrimination threshold is shown as line 112 in FIG. 8. The discrimination function may be implemented using conventional components known to those of ordinary skill in the art employing any one of a (i) fixed discrimination; (ii) variable discrimination; and (iii) variable discrimination with hysteresis.

As further seen in FIG. 8, in some orientations and in some locations (i.e., with respect to the offset distance from the reader antenna), the coupling difference between a pin in the pin-up position and a pin in the neck-on-body condition is small. Accordingly, in another aspect of the present invention, the discrimination of a pin in the pin-up position (trace 104) can be improved with respect to the neck-on-body condition (trace 108) by including a Receive Signal Strength Indicator (RSSI) signal. This is shown as block 83 in FIG. 4. This additional functionality can be used to replace the default, predetermined threshold as indicated by discrimination line 112 with a calibrated threshold as indicated by discrimination line 114. For example, this recalibration may occur at the start of each frame. That is, the actual receive signal strength of a pin-up pin can be used to substantially set the calibrated discrimination line 114 and can be used to reject coupling conditions that are weaker than this threshold. In this way, "neck-on-neck" conditions (trace 108) that may be improperly interpreted as a pin-up, may be properly identified. In a preferred embodiment, therefore, an RSSI circuit 83 may be included in connection with the reader filter/amplifier circuit 82. RSSI circuit 83 may comprise conventional components known to those of ordinary skill in the art, and are quite often offered on commercial components (e.g., in connection with processor 73 of RFID tag 74). In one embodiment, the RSSI circuit has a logarithmic response. Of course, other circuits providing an output indicative of the strength or level of the input are known and may be included.

Figure 9:
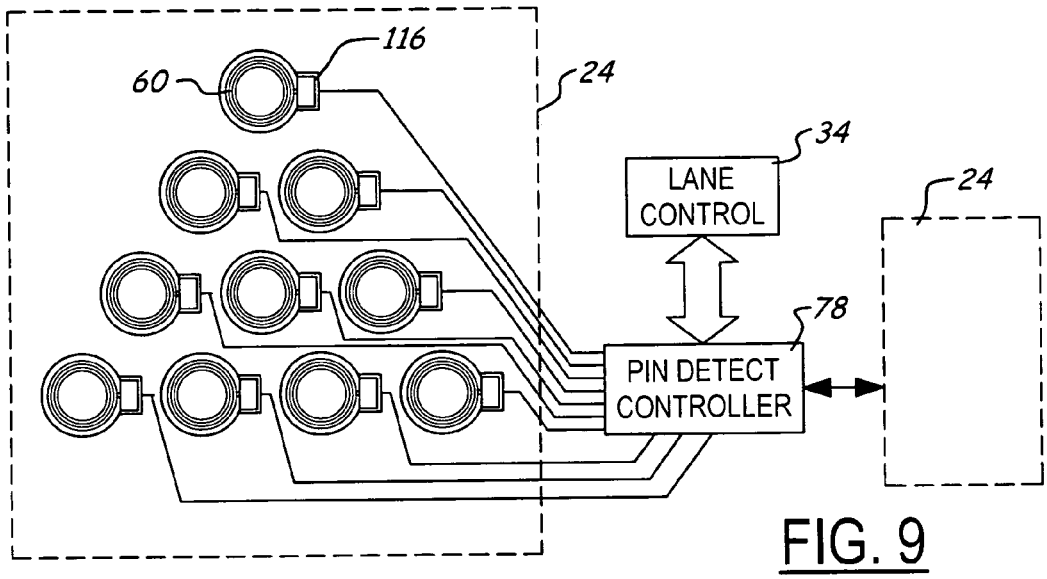
FIG. 9 is a plan view of a first embodiment of an architecture for a plurality of reader antennas each having respective antenna drive circuitry and having overall central monitoring.

FIG. 9 shows a first embodiment of an architecture for a reader antenna array disposed in a pin deck so as to correspond to a predetermined arrangement of bowling pins. FIG. 9 shows a plurality of monitor blocks 116, one for each reader antenna 60. Each monitor block 116 includes an antenna drive circuit such as that described above as circuit 80 in connection with FIG. 4. Each monitor block 116 is responsive to an activation signal from the controller 78 to energize its associated reader antenna 60. Each monitor block 116 further includes a filter/amplifier circuit for processing sensed modulations in its associated reader antenna 60, which may be the same as the filter/amplifier circuit 82 described above in connection with FIG. 4. A connection is made between each monitor block 116 and pin detect controller 78, such connection carrying DC power to the monitor block 116, and for conveying the raw data output signal 87 from monitor block 116 to pin detect controller 78. As shown, it is contemplated that one controller 78 would control the reader antennas both on left and right lanes (pin decks 24).

Figure 10:
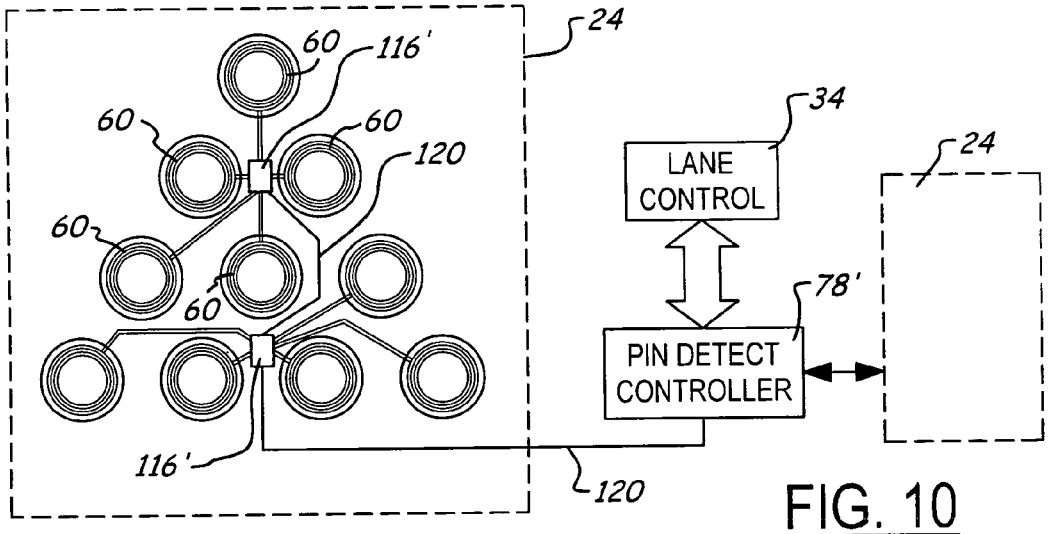
FIG. 10 is a plan view of a second embodiment of an architecture for a plurality of reader antennas having a plurality of monitor blocks servicing one or more reader antennas with the monitors being networked to a central control.

FIG. 10 shows a second embodiment of an architecture for a reader antenna array disposed in pin deck 24. The embodiment of FIG. 10 includes a plurality of modified monitor blocks, designated as monitor block 116', that includes all of the functionality described above in connection with the monitor block 116, but that further includes a network interface configured to access networking media 120. The network interface is configured to allow communications between and among the monitor blocks 116', and being further configured to allow communication between the monitor blocks 116' and a pin detect controller 78'. The networking media is shown as communication media 120. For example only, the networking interface may comprise a CAN (Controller Area Network) bus, an interface known to those of ordinary skill in the art. CAN Interface devices are commercially available from numerous manufacturers. Again, it is contemplated that controller 78' will service adjacent lanes (i.e., 20 reader antennas on two pin decks 24).

Figure 11:
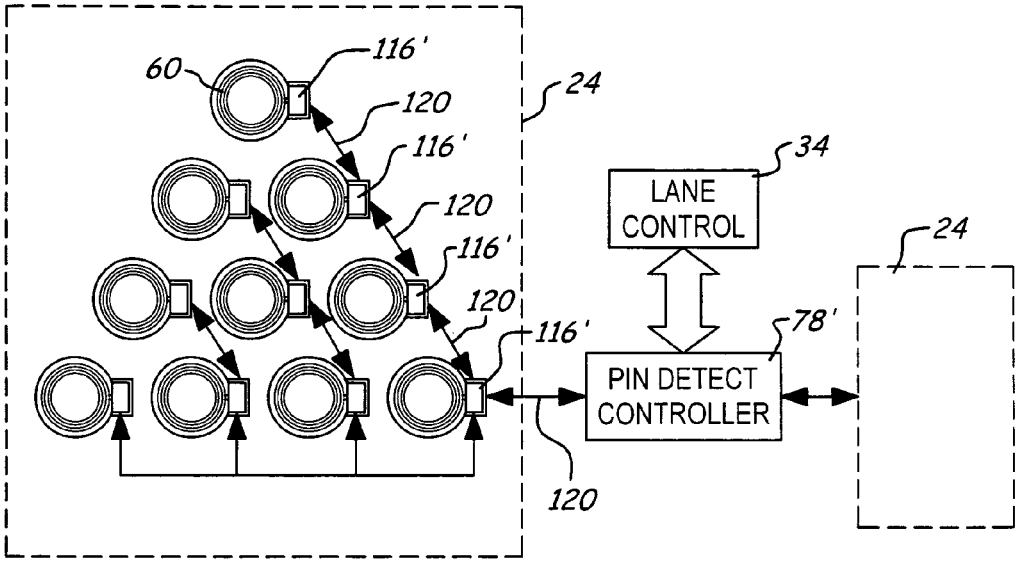
FIG. 11 is a plan view of a third embodiment of an architecture for a plurality of reader antennas having a monitor block for each antenna with the monitors being networked to a central control.

FIG. 11 is a third embodiment of an architecture for a reader antenna array corresponding to a predetermined arrangement for the bowling pins. The embodiment of FIG. 11 is the same as the embodiment of FIG. 10 except than a monitor block 116' is used with each one of the plurality of reader antennas 60.

Figure 12:
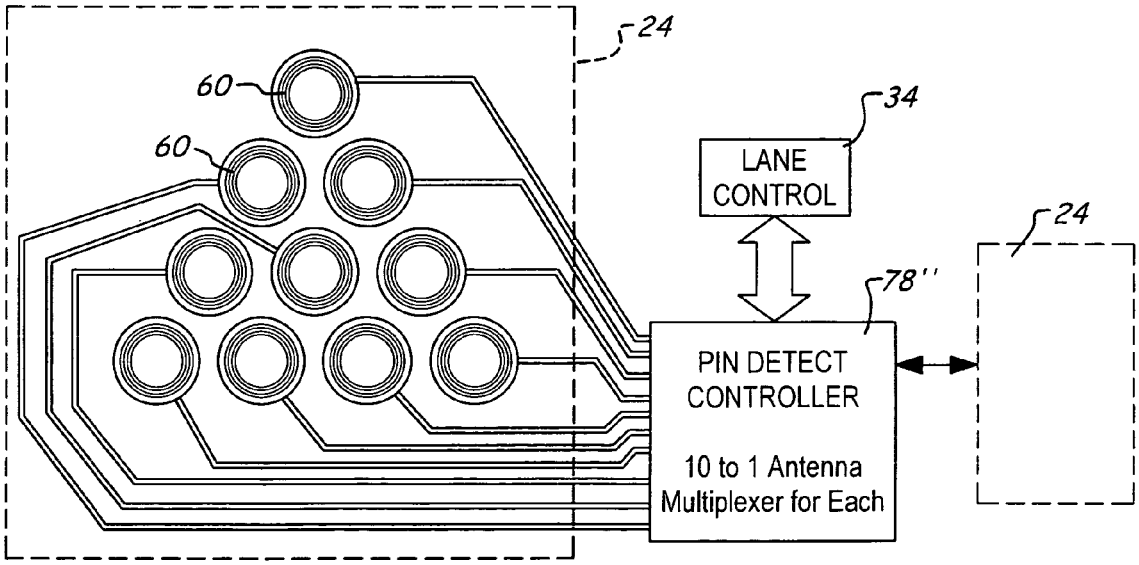
FIG. 12 is a plan view of a fourth embodiment of an architecture for a plurality of reader antennas having centralized and multiplexed antenna drive circuitry and control.

FIG. 12 is a fourth embodiment of an architecture for an array of reader antennas 60 wherein the coil terminals of each reader antenna 60 are routed directly to a pin detect controller 78?. In a preferred embodiment, controller 78? is configured to sequentially energize each reader antenna 60 in a multiplexed fashion (as opposed to having a dedicated drive circuit for each reader antenna 60), which will be described in connection with FIG. 21. Accordingly, controller 78? in FIG. 12 includes (1) antenna drive circuitry; (2) reader filter/amplifier circuitry; and (3) processing and interpretation functionality, just as shown in FIG. 4. It is contemplated that controller 78? can be configured to service adjacent lanes (i.e., 20 reader antennas).

Figure 13:
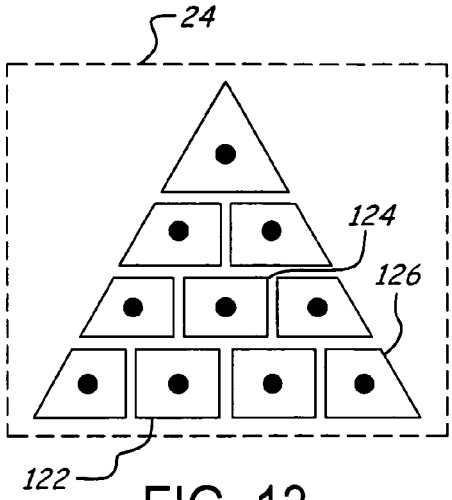
FIG. 13 is a diagrammatic view showing reader antennas with alternate geometries configured to reduce dead zones.
Figure 14:
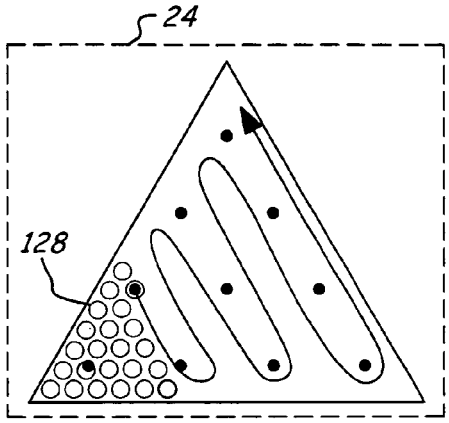
FIG. 14 is a diagrammatic view showing an alternate embodiment for the reader antennas configured for dead zone reduction involving a plurality of individual reader antennas for each pin position.

FIGS. 13–14 show embodiments configured to minimize "dead zones", areas in the reader antenna array that do not provide reader field 76 coverage. One challenge is to properly detect when a bowling pin is in the pin-up position, as opposed to when the bowling pin is in the pin-down position, and this discrimination is made more challenging in the sliding pin situation when using circle-shaped reader antennas because of these dead zones. According to the invention, FIG. 13 shows a first embodiment wherein the reader antennas are configured in non-circular geometries to reduce "dead zones". The geometries for the reader antennas shown in FIG. 13 are of various types, including square (designated 122), rectangle (designated 124), and quadrilateral shapes (designated 126), all of which are configured to reduce the area where the reader field does not exist (i.e., a "dead zone").

FIG. 14 shows a second embodiment for the reader antenna array configured to reduce the impact of "dead zones." In the embodiment of FIG. 14, each position in the predetermined arrangement for the bowling pins is covered by a plurality of reduced-size reader antennas, one of which is designated by reference numeral 128. Through the foregoing, the area not covered by the reader field (i.e., the "dead zones") is reduced.

Figure 15:
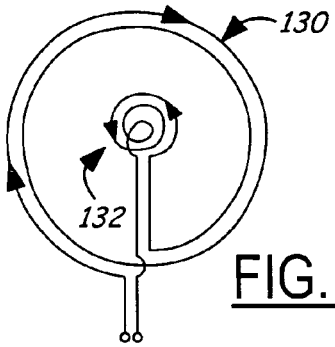
FIG. 15 is a diagrammatic view of a still further reader antenna embodiment having clockwise and counter-clockwise inner and outer segments.

FIG. 15 shows a still further embodiment of the reader antenna 60 which includes (i) a first, inner circular-shaped reader antenna 132 wound in one of a clockwise (CW) and counter-clockwise (CCW) orientations and (ii) a second, outer circular-shaped reader antenna 130 wound in the other one of the clockwise and counter-clockwise orientations. As shown, the outer coils are wound in a CW fashion while the inner coils are wound in a CCW fashion. The dual winding arrangement, specifically the CW and CCW orientations, minimizes the reader antenna sag of the signal level, as shown in FIG. 8 (i.e., minimizes the null shown in trace 104 in FIG. 8).

Figure 16:
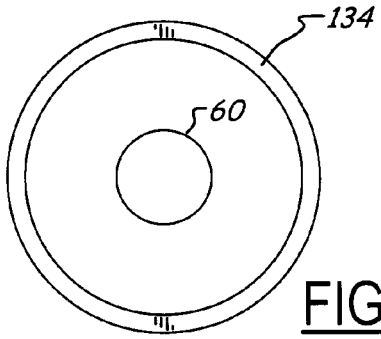
FIG. 16 is yet a further embodiment of a reader antenna having an inner reader antenna circumscribed by a outer portion formed of mu metal.

FIG. 16 is a still further embodiment of a reader antenna arrangement wherein an inner reader antenna 60 is circumscribed therearound by an outer circle 134 formed of mu metal configured to reduce interference from magnetic fields originating from other ones of the reader antennas. Mu metal minimizes or prevents penetration into a region surrounded by the mu metal by external magnetic fields. The arrangement in FIG. 16 reduces inter-reader antenna coupling, thereby improving accuracy in making determinations as to pin-up positions of the pins.

Figure 17:
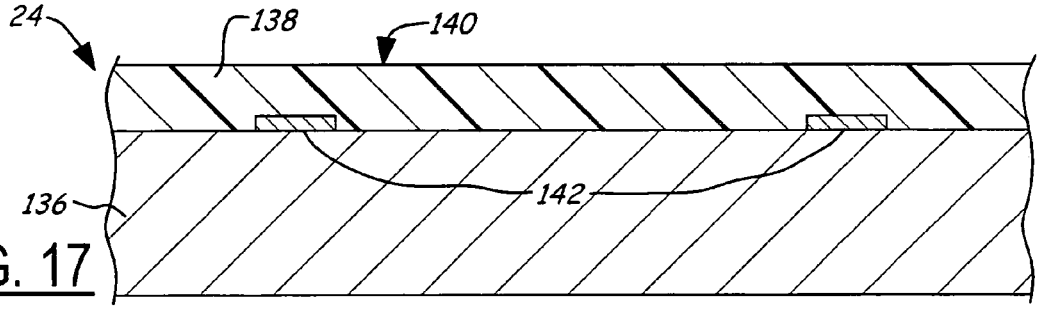
FIG. 17 is a cross-sectional view of a first embodiment of a pin deck having a plurality of reader antennas.
Figure 18:
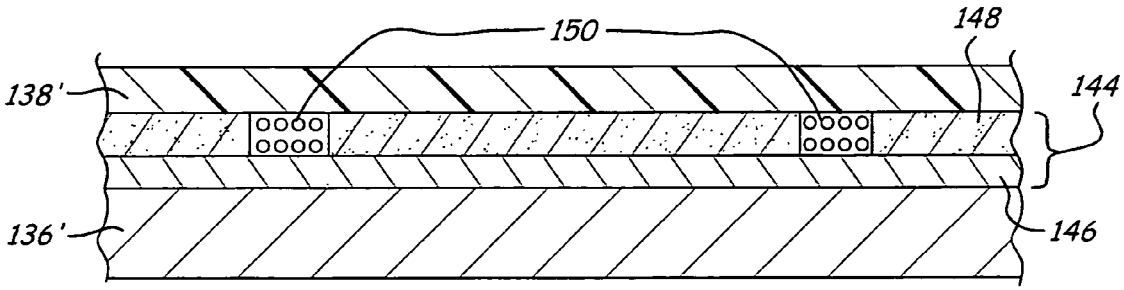
FIG. 18 is a cross-sectional view of a second embodiment of a pin deck having a plurality of reader antennas.
Figure 19:
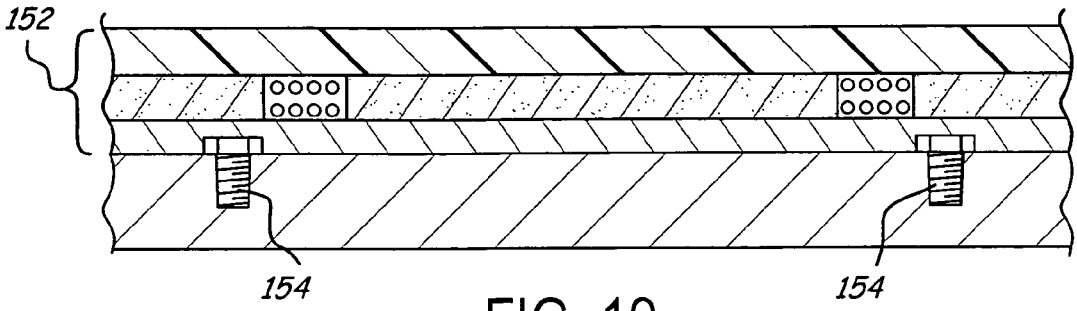
FIG. 19 is a cross-sectional view of a third embodiment of a pin deck having a plurality of reader antennas with the reader antenna portion configured as a serviceable unit.

FIGS. 17–19 illustrate various embodiments of a pin deck configured with a reader antenna in accordance with the present invention. All of the embodiments of FIGS. 17–19 include a base layer, an upper layer, and a reader antenna intermediate the base layer and the upper layer. The reader antenna itself may have a construction selected from the group comprising (1) conductors patterned on a printed circuit board (PCB), (2) conductors disposed in a flex circuit, for example, formed of electrical insulating material such as polyimide material; and (3) a wire-wound coil disposed in a retaining recess formed in a substrate formed of electrically-insulating material.

FIG. 17 is a first embodiment of a pin deck 24 including an array of reader antennas. Pin deck 24 includes a base layer 136, an upper layer 138 having a top surface 140 configured for placement of a plurality of bowling pins in a predetermined arrangement, and one or more reader antennas disposed intermediate the base layer 136 and the upper layer 138. FIG. 17 shows a cross-section of one reader antenna comprising a plurality of individual conductors 142. That is, FIG. 17 is a partial cross-section view through one reader antenna 60. Base layer 136 may comprise durable, natural wood material (e.g., maple), or may be of synthetic construction. Manufacture of a synthetic base layer for a pin deck is known in the art, as seen by reference to U.S. Pat. No. RE 35,778 entitled STRUCTURE FOR RESURFACING BOWLING LANES, hereby incorporated by reference in its entirety. Upper layer 138 may comprise a polymer sheet of a suitable thickness (e.g., 0.050 inches) and of suitable durability. Such a synthetic, upper layer may comprise commercially available products available from the assignee of the present invention under the trademark LANE SHIELD, which is also described in U.S. Pat. No. 6,450,892 entitled BOWLING LANE RESTORATION AND SHIELDING SHEET AND METHOD OF ASSEMBLY, hereby incorporated by reference in its entirety. In the embodiment of FIG. 17, the upper layer 138 may be provided as an aftermarket enhancement with the array of reader antennas adhered on a bottom surface thereof opposite the top surface 140. Layer 138 may be attached/adhered to the base layer 136 by conventional means (e.g., double-sided tape, etc.). In an aftermarket installation situation, a frame underlying base layer 136 (i.e., the original pin deck) may simply be adjusted so as to reduce the height of the overall assembly so that the top surface 140 is substantially flush with the top surface of the adjacent bowling lane.

The embodiment of FIG. 18 includes a base layer of an alternate construction, designated by reference numeral 136', and an upper layer of an alternate construction, designated by reference numeral 138', and having a sandwich assembly 144 intermediate the base layer 136' and upper layer 138'. The sandwich assembly 144 includes the array of reader antennas corresponding in number and placement to the predetermined arrangement for the bowling pins on the pin deck. The sandwich assembly 144 includes a carrier layer 146 and a retention layer 148 affixed to the carrier 146. The retention layer includes a plurality of retaining recesses 149, one for each pin position. Wire wound coils corresponding in size and shape to and disposed in the retaining recesses define the reader antennas. FIG. 18 shows a partial cross-section through one such reader antenna, the cross-section through the wire wound coils being designated by reference numeral 150. Base layer 136' may be of synthetic construction, such as described in U.S. Pat. No. RE 35,778 while the upper layer 138 may be Formica or the like of suitable durability and amenable to a decorative presentation visible from the top (e.g., to simulate a species of wood).

The embodiment of FIG. 19 is substantially the same as the embodiment of FIG. 18, except that the sandwich layer 144, and the top, upper layer 138' are combined as a single, serviceable unit 152 mechanically, and removably attached to the base layer 136' through the use of conventional fasteners 154, or the like. Accordingly, in the embodiment of FIG. 19, should one of the reader antennas fail for some reason, removal and repair, and/or partial salvage of the pin deck 24 may be made by simply replacing the serviceable unit 152.

Figure 20:
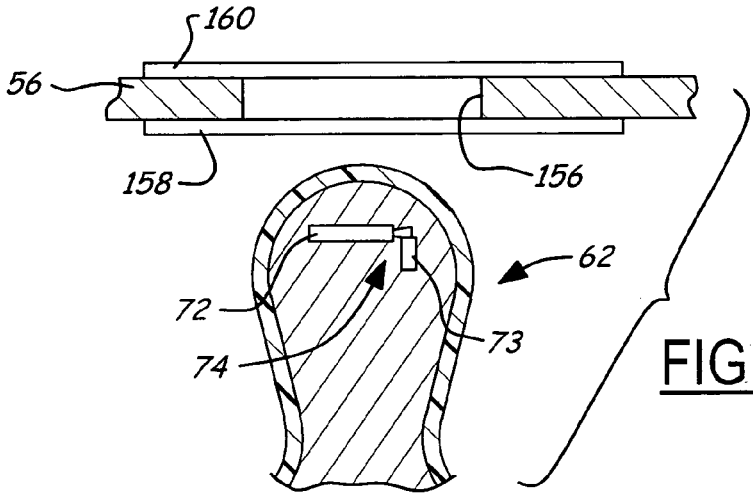
FIG. 20 is a cross-sectional view of a reader antenna disposed in a setting table of a pinsetter.

FIG. 20 illustrates a further embodiment wherein the array of reader antennas is disposed proximate the setting table 56 of pinsetter 32. With particular reference to FIG. 20, bowling pin 62 includes a pin antenna 72 and an RFID tag 74 coupled thereto, all located in the head portion of pin 62. Shown in proximity thereof, is a setting table 56 of the pinsetter 32 (shown in FIG. 4). The setting table 56 includes a plurality of apertures 156 sized and configured in shape to accommodate the head of respective bowling pins 62. In one embodiment, a reader antenna, designated by reference numeral 158, is located on an underside of setting table 56. In an alternate embodiment, the reader antenna, designated by reference numeral 160, is situated on an upper side of the setting table 56. The advantage of the arrangement of reader antenna 158 is that it need not fully contend with the magnetic effects and permeability of the setting table itself. One advantage of the arrangement of reader antenna 160 is that it need not contend with the shock impacts of bowling pins, as it is somewhat protected by the setting table 56.

Figure 21:
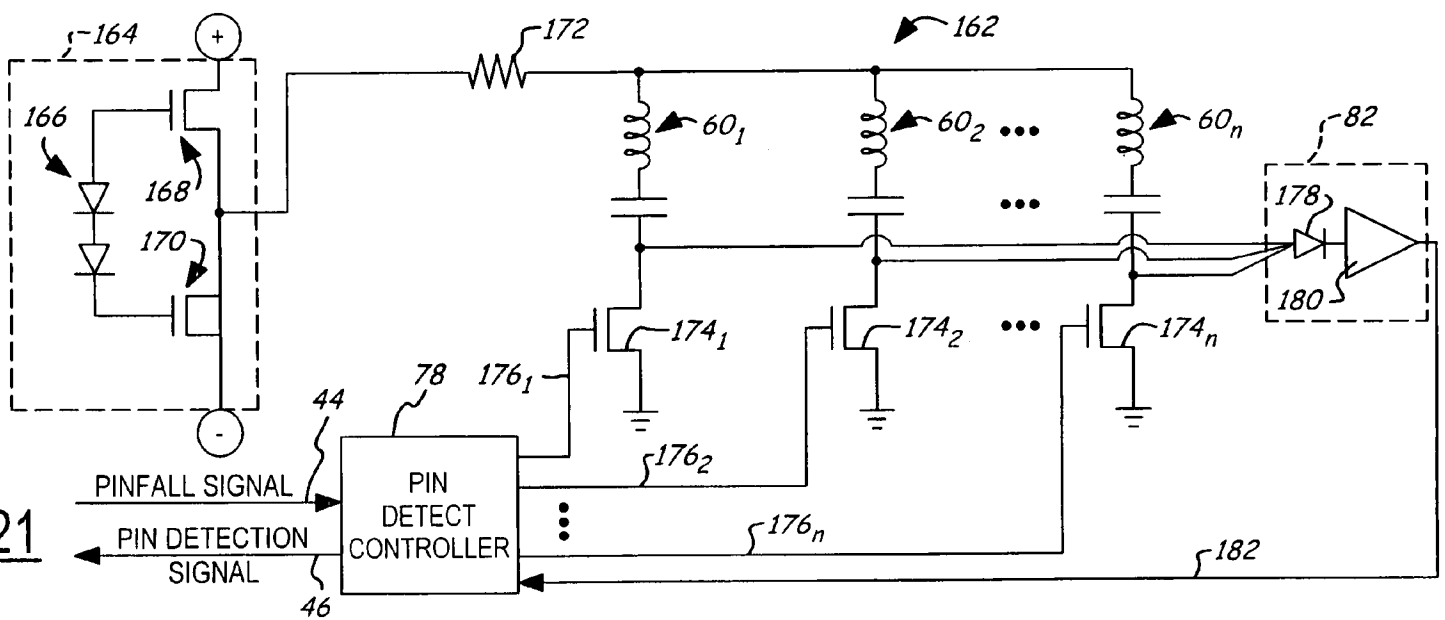
FIG. 21 is a schematic and block diagram view showing a multiplexed antenna drive circuit.

FIG. 21 is a schematic and block diagram of a multiplexed reader antenna drive circuit 162, which may be used, for example, in the pin detect controller 78 of FIG. 12. Circuit 162 includes an AC generator block 164, which includes series-connected diodes 166, and upper and lower transistor devices 168 and 170. AC generator 164 is configured to produce an AC signal suitable for use in energizing reader antennas 60. In one embodiment, AC generator 164 is configured to generate a 125 kHz signal. Resistor 172 is a coupling resistor.

Transistors $\mathbf{174}_1$, $\mathbf{174}_2$, . . . $\mathbf{174}_N$ are responsive to respective activation signals $\mathbf{176}_1$, $\mathbf{176}_2$, . . . $\mathbf{176}_N$ for energizing respective reader antennas $\mathbf{60}_1$, $\mathbf{60}_2$, . . . $\mathbf{60}_N$. Activation signals $\mathbf{176}_1$, $\mathbf{176}_2$, . . . $\mathbf{176}_N$ are generated by pin detect controller 78 in response to pin fall signal 44. Pin detect controller 78 is configured to sequentially, within a predetermined time window, activate each reader antenna in turn for a predetermined subperiod of time.

Figure 22:
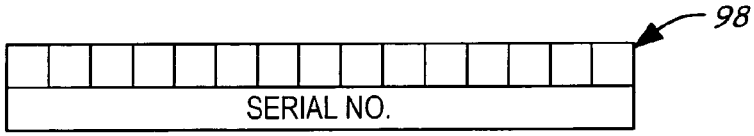
FIGS. 22–24 show alternate embodiments for a code stored in the memory of an RFID tag for a bowling pin.
Figure 23:
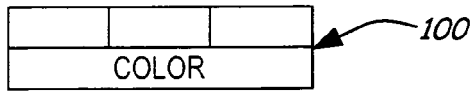
Figure 24:
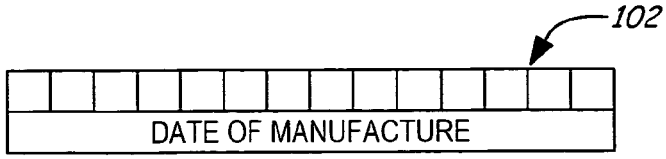

Also shown in FIG. 21 is an amplifier/filter circuit 82, which may comprise a diode 178 and amplifier 180. As described above, circuit 82 is configured to process sensed modulations in the reader antenna to provide an output signal 182 corresponding to the modulations. Output signal 182 is a raw, digital data signal corresponding to the output signals 87 combined in a time multiplexed fashion. Pin detect controller 78 is configured to process the digital data stream, demodulate, if needed, in order to recover the original data being transmitted. This original data may come in the form of multi-bit digital words, such as a bowling pin serial number 98 (see FIG. 22), a color of the bowling pin 100 (see FIG. 23) or a date of manufacture of the pin (see FIG. 24) or a combination of any of the above. Circuit 82 is further configured to provide discrimination functionality to discriminate between pins in the pin-up position as opposed to pins in the pin-down position, as described above in connection with FIG. 8. Circuit 82 may also be coupled to a circuit to perform the RSSI function (e.g., block 83 in FIG. 4), again, as described above.

Pin detect controller 78, after interrogating each reader antenna in sequence in a multiplexed fashion in response to the pin-fall signal 44, and performing appropriate demultiplexing of the raw digital signal on line 182, is configured to determine the pins left standing and provide this to lane control system 34 as the pin detection signal 46. In another embodiment, the pin detect controller 78, having predetermined knowledge of the identity of the initial pins set on the pin deck, can determine which pins have been knocked down by the bowler's throw by using the determination of what pins are left standing, and provide that information (i.e., the pins in the pin-down position) as the pin detection signal 46.

Figure 25:
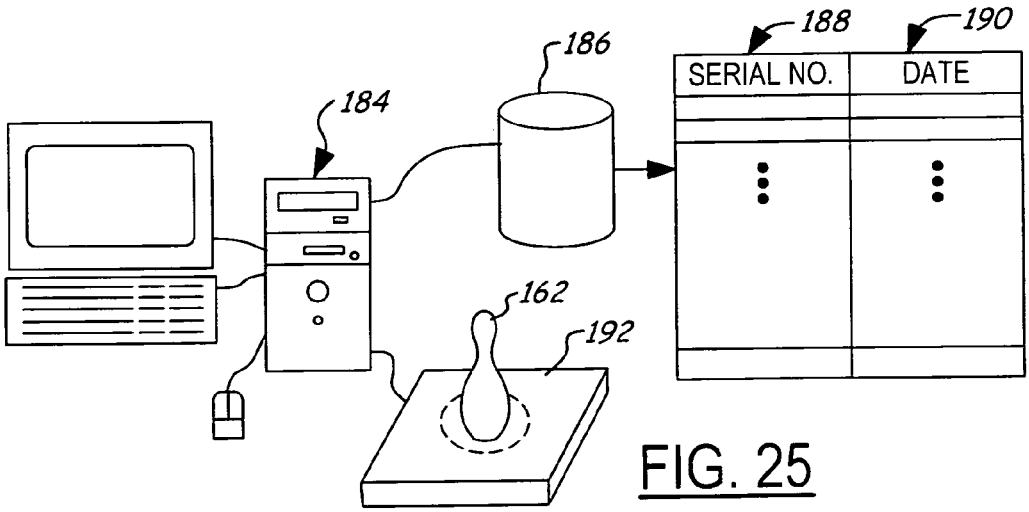
FIG. 25 is a diagrammatic view of a system configured for tracking a bowling pin.

FIG. 25 is a diagrammatic view showing one application of the invention for bowling pin tracking. FIG. 25 shows a computer system 184 including a database 186 that includes a serial number field 188 and a deployment date field 190. FIG. 25 further shows a pin 62 on a interrogation fixture 192. In the embodiment of FIG. 25, the bowling pin 62, particularly the RFID tag included therein, include an identification code that is a serial number unique to that pin. A method of tracking a bowling ball may comprise the basic steps as follows. First, providing a bowling pin 62 having a pin antenna configured to generate a power signal in response to a reader field, and an RFID tag responsive to the power signal for activation thereof. The RFID tag is configured to store an identification code for identifying the pin, for example, in the form of a serial number. The next step involves deploying the bowling pin on a first, deployment date. The next step involves associating the identification code with the deployment date in a computer database 186. For example, this may be done at the manufacturing site, or at the shipping site of the manufacturer when an order for pins is fulfilled. On a second date subsequent to the deployment date, the next step is performed which is applying a reader field to the bowling pin to thereby activate the RFID tag in order to obtain the identification code. Finally, the last step of the method involves retrieving the deployment date using the identification code.

Through the following method, a proprietor may determine how long a bowling pin has been in use by performing the additional step of determining the length of deployment using the first, deployment date, and the second date noted above. For example when a pin has become cracked or otherwise unusable, one may determine warranty coverage using the retrieved deployment date and warranty data associated with the pin. Additionally, a proprietor may wish to preemptively replace pins after a predetermined period of time (e.g., 1 year). It should be understood that the fixture 192 is exemplary only. For example, a proprietor may use pin deck 24 configured with reader antennas to obtain the pin serial number. Other applications, of course, are possible.

Figure 26:
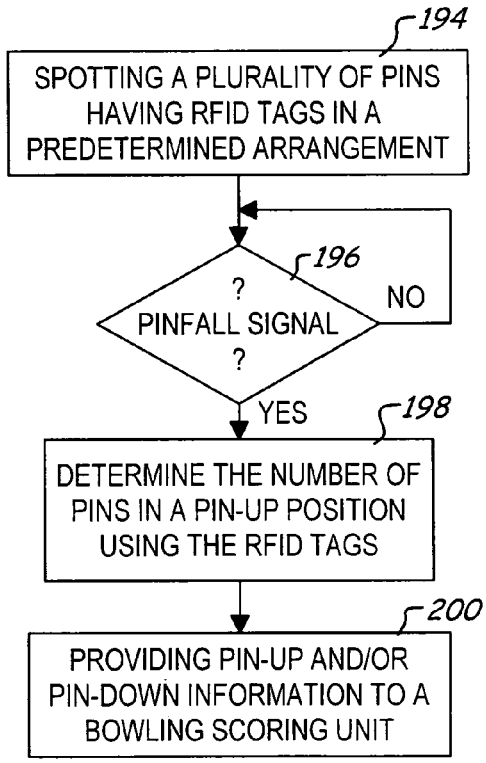
FIG. 26 is a flowchart diagram showing the operation of an RFID pin detection system.

FIG. 26 shows another embodiment of the present invention, suitable for use in automatic scoring. A method of bowling includes plural steps. In step 194, the method begins with the step of spotting a plurality of pins having RFID tags in a predetermined arrangement (e.g., on a pin deck). Each RFID tag is configured to produce an identification signal responsive to a reader field, as described herein. The method then proceeds to step 196.

In step 196, the method enters a decision step as to whether it has received a pin fall signal indicating that a bowler has completed the throw of a bowling ball and it is thus an appropriate time to check for fallen pins. If the answer to this step is "NO," then the method loops on itself in a wait state. Otherwise, if the answer is "YES," the method branches to step 198.

In step 198, the method continues with the step of determining the number of pins in the pin-up position using the RFID tags. This method may be implemented as described in the various embodiments herein. The method then proceeds to step 200.

In step 200, the method continues with the step of providing either pin-up and/or pin-down information to a bowling scoring unit. The bowling scoring unit may then process this information, as is conventional.

A further embodiment of the method may include further steps in order to track bowling pin usage as well as to implement particular bowling games. For example, after spotting of the pins but before the pin fall signal is generated, the method may include the further step of determining the identity of at least one, and preferably all, of the pins that have been set on the pin deck in the predetermined arrangement, and, incrementing a usage parameter associated with the identified pins. In this way, a running total may be obtained of the number of cycles (frames) a bowling pin has been used. This will allow, for example, an operator to conduct preventative maintenance and/or replacement of pins as they approach known, preselected usage milestones.

In another variation, it is known to configure bowling center control 38 with the capability of allowing a certain bowling game to be played on lanes that involve identification of the color of the bowling pin. For example, a "red" color pin may randomly circulate through the bowling center. Should that pin be spotted in the pin number one position, a subsequent strike by the bowler would result in a reward, such as a money prize or house credit, being awarded to that bowler. The present invention provides the capability to implement the playing of that game by either (1) hard coding the color of the pin in the identification code of the RFID tag, or (2) virtually associating a particular serial number associated with the bowling pin with a color. In either of these conditions, the method may be performed to include the following further steps. First, after spotting the pins on the pin deck but before the pin fall signal, determining the identity of the pins that have been spotted on the pin deck. Second, providing the identity of such pins to the bowling game unit (e.g., executing on lane control system 34 or on the bowling center control 38) that is configured to control the playing of the bowling game. Next, generating a signal when the identity of one of the pins matches predetermined criteria. The last step involves altering either the rules of the bowling game or an outcome in response to such signal. As described above, in one embodiment, the identity of such a pin may include the color characteristic of the pin and the predetermined criteria programmed into the lane control system 34 (or other game playing unit) may comprise a preselected color. In this situation, the bowler can win the predetermined reward or prize for bowling a strike (or other specified act such as a spare, or spare on a split, etc.) when the color of the at least one pin matches the preselected color. Additionally, the game requirement may specify a particular position for the specified-color pin. Pin detection system 40 can provide this information as well, as described above.

The invention claimed is:

1. A system comprising:

a reader antenna configured to generate a reader field; and a bowling pin comprising:

a body having a base, a neck and a head portion; and a radio-frequency identification (RFID) tag having a pin antenna, said pin antenna being associated with said body and configured to generate a power signal in response to said reader field, said RFID tag further including a processor responsive to said power signal for activation thereof wherein said RFID tag is configured to produce an identification signal for identifying said pin;

wherein said pin antenna and said reader antenna having a first level of inductive coupling through said reader field therebetween when said pin is in a pin-up position, said pin antenna and said reader antenna having a second level of inductive coupling therebetween when said pin is in a pin-down position, said pin antenna and said reader antenna being arranged with respect to each other such that said first level is discriminatable from said second level for determining the position of the bowling pin.

2. The system of claim 1 wherein said pin antenna is disposed in said head.

3. The system of claim 1 wherein said pin antenna is disposed in said base.

4. The system of claim 3 wherein said base includes a cavity configured in size and shape to accommodate said pin antenna, said pin further including an encapsulant to embed said pin antenna in said cavity.

5. The system of claim 4 wherein said pin antenna is circular in shape.

6. The system of claim 3 wherein said bowling pin includes a main axis extending through said base, neck and head portions, said pin antenna enclosing an area through which said main axis passes.

7. The system of claim 6 wherein said pin antenna comprises a plurality of loops of electrically conducting material and lies generally in a plane, said plane being substantially perpendicular to said main axis of said pin.

8. The system of claim 1 wherein said RFID tag is configured to communicate a stored digital code.

9. The system of claim 8 wherein said code identifies said bowling pin by a serial number.

10. The system of claim 8 wherein said code identifies a date of manufacture of said bowling pin.

11. The system of claim 8 wherein said code identifies a color of said bowling pin.

12. The system of claim 1 further comprising a gravity-actuated switch having an open position and a closed position, said switch being arranged in said pin so as to assume one of said open and closed positions when said pin is in said pin-up position and to assume the other one of said open and closed positions when said pin is in said pin-down position, said switch being electrically coupled to at least one of said pin antenna and said processor so as to alter the operation of said one pin antenna and processor in dependence on whether said pin is in said pin-up or pin-down position.

13. A pin deck at a first end of a bowling lane opposite a second, approach end, said pin deck comprising:

a base layer;

an upper layer having a top surface configured for placement of a plurality of bowling pins in a predetermined arrangement; and a reader antenna intermediate said base layer and said upper layer, said reader antenna being configured to radiate a reader field to a corresponding position in said predetermined arrangement, said reader antenna being further configured to sense modulations in said reader field when one of said bowling pins, which includes a radio-frequency identification (RFID) tag having a pin antenna, is within a range of said position;

wherein said pin antenna of said one of said bowling pins and said reader antenna having a first level of inductive coupling through said reader field therebetween when said one of said bowling pins is in a pin-up position, said pin antenna and said reader antenna having a second level of inductive coupling therebetween when said one of said bowling pins is in a pin-down position, said pin antenna and said reader antenna being arranged with respect to each other such that said first level is discriminatable from said second level for determining the position of said one of said bowling pins.

14. The pin deck of claim 13 including a plurality of reader antennas at least one reader antenna for each position in said predetermined arrangement.

15. The pin deck of claim 14 including a plurality of reader antennas for at least one of said positions of said predetermined arrangement.

16. The pin deck of claim 15 wherein said plurality of reader antennas for said at least one position includes (i) a first, inner circular shaped reader antenna wound in one of a clockwise (CW) and counter clockwise (CCW) orientations and (ii) a second, outer circular shaped reader antenna wound in the other one of said clockwise and counterclockwise orientations.

17. The pin deck of claim 14 wherein said reader antennas are in a circular in shape.

18. The pin deck of claim 17 wherein at least one of said reader antennas is circumscribed therearound by mu metal configured to reduce interference from magnetic fields originating from other ones of said reader antennas.

19. The pin deck of claim 14 wherein said reader antennas comprise at least one of a square, rectangle, and quadrilateral shape.

20. The pin deck of claim 14 further including (i) a respective antenna drive circuit disposed proximate each of said reader antennas for energization thereof and (ii) a respective filter and amplifier circuit configured to process said sensed modulations to produce a respective output signal.

21. The pin deck of claim 20 wherein each of said output signals comprises raw digital data corresponding to a code stored in the corresponding said RFID tag.

22. The pin deck of claim 14 further including a plurality of monitor blocks, each monitor block including an antenna drive circuit configured to energize at least one reader antenna and a filter and amplifier circuit configured to process said sensed modulations to produce a respective output signal, each monitor block further including a respective network interface for allowing access to networking media, said interface configured to allow communication between and among said monitor blocks, said interface being further configured to allow communication between said monitor blocks and a pin detect controller.

23. The pin deck of claim 22 wherein the number in said plurality of monitor blocks corresponds to the number of positions in said predetermined arrangement.

24. The pin deck of claim 22 wherein said monitor block further includes a received signal strength indicator (RSSI) circuit configured to generate a strength signal indicative of a power level of said sensed modulations sensed.

25. The pin deck of claim 14 wherein said reader antenna has a construction selected from the group comprising conductors patterned on an printed circuit board (PCB), conductors disposed in a flex circuit of polyimide material, and a wire-wound coil disposed in a retaining recess formed in a substrate formed of electrically insulating material.

26. The pin deck of claim 14 wherein said base layer comprises one of a synthetic laminate material and a natural wood material, and said upper layer comprises a single, continuous polymer sheet.

27. The pin deck of claim 26 wherein said reader antennas have a construction selected from the group comprising conductors patterned on a printed circuit board (PCB) and conductors disposed in a flex circuit of polyimide material.

28. The pin deck of claim 14 wherein said base layer comprises a synthetic laminate material and said upper layer comprises a synthetic material having a decorative appearance, said reader antennas being formed in a sandwich assembly comprising:

a carrier;

a retention layer affixed to said carrier and including a plurality of retaining recesses formed therein corresponding to said predetermined arrangement for said bowling pins; and a plurality of wire-wound coils corresponding in size and shape to and disposed in said retaining recesses defining said reader antennas.

29. The pin deck of claim 28 wherein said sandwich assembly and said upper layer are removably affixed to said base layer.

30. An automatic bowling pinsetter comprising:

a pin elevator configured to receive bowling pins from a pit conveyor and elevate said pins to an orienting and delivery mechanism, said mechanism being configured to orient said bowling pins in a desired fashion and to deliver said oriented pins to a plurality of pin stations;

a setting table disposed proximate said pin stations for receiving bowling pins for setting on a pin deck in a predetermined arrangement, said table having a plurality, of tipping baskets corresponding to said predetermined pin arrangement, said baskets being configured to selectively engage, hold and release said bowling pins, said setting table being movable between upper and lower positions;

a rake for removing pins from said pin deck; and a plurality of reader antennas proximate said setting table configured to radiate a reader field to a corresponding position in said predetermined arrangement, each reader antenna being further configured to sense modulations in a respective reader field when a bowling pin including a radio-frequency identification (RFID) tag having a pin antenna is within a respective range of said radiated position;

wherein a reader antenna and pin antenna having a first level of inductive coupling through said respective reader field therebetween when a pin associated with the pin antenna is in a pin-up position, said reader antenna and said pin antenna having a second level of inductive coupling therebetween when said pin is in a pin-down position, said reader antenna and said pin antenna being arranged with respect to each other such that said first level is discriminatable from said second level for determining the position of the pin associated with the pin antenna.

31. The pinsetter of claim 30 wherein said setting table includes a first side configured to face said pin deck, said reader antennas being disposed on said first side.

32. The pinsetter of claim 30 wherein said setting table includes a first side configured to face said pin deck and a second side opposite said first side, said reader antennas being disposed on said second side of said setting table.

33. A bowling pin fall detection system for use with bowling pins placed in a predetermined arrangement on a pin deck wherein each pin includes a respective radio-frequency identification (RFID) tag having a pin antenna and configured to identify said respective pin, said system comprising:

a pin detect controller responsive to a pin fall signal to generate a reader antenna activation signal;

a monitor block including an antenna drive circuit responsive to said activation signal configured to energize said reader antennas;

a plurality of reader antennas configured to radiate a respective reader field to a corresponding position in said predetermined arrangement, said reader antennas being further configured to sense modulations in respective reader fields when one of said bowling pins is within a respective range of said radiated positions; wherein a reader antenna and pin antenna having a first level of inductive coupling through said respective reader field therebetween when a pin associated with the pin antenna is in a pin-up position, said reader antenna and said pin antenna having a second level of inductive coupling therebetween when said pin is in a pin-down position, said reader antenna and said pin antenna being arranged with respect to each other such that said first level is discriminatable from said second level for determining the position of the pin associated with the pin antenna;

said monitor block further including a filter and amplifier circuit configured to process said sensed modulations from each reader antenna for detecting said bowling pins in a pin-up position and for generating an output signal;

said pin detect controller being responsive to said output signal from said monitor block to generate a pin detection signal indicative of at least one of (i) a number of bowling pins in said pin-up position; and (ii) a number of pins in a pin-down position.

34. The pin fall detection system of claim 33 wherein said RFID tag is configured to communicate a stored digital code through said modulations.

35. The pin fall detection system of claim 34 wherein said code identifies said bowling pin by a serial number.

36. The pin fall detection system of claim 33 wherein said code identifies a date of manufacture of said bowling pin.

37. The pin fall detection system of claim 33 wherein said code identifies a color of said bowling pin.

38. A method of bowling comprising the steps of (A) spotting a plurality of bowling pins on a pin deck in a predetermined arrangement wherein each bowling pin includes a respective RFID tag having a pin antenna configured to produce an identification signal responsive to a reader field;

(B) in response to a pin fall signal indicative of a time to perform a pin count, determining the number of pins in a pin-up position using the RFID tags; and (C) providing the determined number to a bowling scoring unit;

wherein the method further comprises generating said reader field with a reader antenna, wherein a pin antenna of a pin and said reader antenna having a first level of inductive coupling through said reader field therebetween when said pin is in the pin-up position, said pin antenna and said reader antenna having a second level of inductive coupling therebetween when said pin is in a pin-down position, said pin antenna and said reader antenna being arranged with respect to each other such that said first level is discriminatable from said second level for determining the position of said pin.

39. The method of claim 38 further including the step of determining the identity of the pins in the pin-up position using the RFID tags.

40. The method of claim 39 further including the step of determining the respective position in the predetermined arrangement of those bowling pins in the pin-up position using the RFID tags.

41. The method of claim 38 further including the steps of after the spotting step and before the pin fall signal, determining the identity of the at least one pin in the predetermined arrangement; and incrementing a usage parameter associated with at least one pin.

42. The method of claim 41 further including the step of determining the identity of each pin in the preselected arrangement; and incrementing a usage parameter associated with each of the identified pins.

43. The method of claim 38 further including the steps of after the spotting step and before the pin fall signal, determining the identity of the at least one pin in the predetermined arrangement;

providing the identity of the at least one pin to a bowling game unit configured to control playing of the bowling game;

generating a change signal when the identity of the at least one pin matches predetermined criteria; and altering one of either the rules of the bowling game and the outcome in response to the change signal.

44. The method of claim 43 wherein the identity of the at least one pin includes a color characteristic of the pin, and the predetermined criteria comprises a preselected color, and wherein the altering step includes the substep of:

providing the bowler with a predetermined prize for knocking down the at least one pin when the color of the at least one pin matches the preselected color.

* * * * *